US009365939B2

(12) United States Patent
Anderson et al.

(10) Patent No.: US 9,365,939 B2
(45) Date of Patent: Jun. 14, 2016

(54) NANOPOROUS MATERIALS FOR REDUCING THE OVERPOTENTIAL OF CREATING HYDROGEN BY WATER ELECTROLYSIS

(75) Inventors: Marc A. Anderson, Madison, WI (US); Kevin C. Leonard, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 284 days.

(21) Appl. No.: 13/149,298

(22) Filed: May 31, 2011

(65) Prior Publication Data

US 2012/0305407 A1 Dec. 6, 2012

(51) Int. Cl.

| | |
|---|---|
| ***C25B 1/04*** | (2006.01) |
| ***C25B 11/06*** | (2006.01) |
| ***C25B 11/03*** | (2006.01) |
| ***C25B 1/02*** | (2006.01) |
| ***C25B 1/24*** | (2006.01) |
| ***C25B 1/26*** | (2006.01) |
| ***C25B 11/04*** | (2006.01) |

(52) U.S. Cl.

CPC ..... *C25B 11/035* (2013.01); *C25B 1/02* (2013.01); *C25B 1/24* (2013.01); *C25B 1/245* (2013.01); *C25B 1/26* (2013.01); *C25B 11/041* (2013.01); *C25B 11/0452* (2013.01); *C25B 11/0478* (2013.01)

(58) Field of Classification Search

USPC ..... 204/252, 266, 278; 205/619, 620, 621, 205/625, 628, 630, 633, 637, 638

See application file for complete search history.

(56) References Cited

U.S. PATENT DOCUMENTS

| | | | | |
|---|---|---|---|---|
| 3,905,884 | A * | 9/1975 | Parenti et al. | 205/349 |
| 4,465,570 | A * | 8/1984 | Oda et al. | 205/638 |
| 4,544,470 | A * | 10/1985 | Hetrick | B01J 35/0033 204/157.47 |
| 4,793,910 | A * | 12/1988 | Smotkin | C25B 1/003 204/268 |
| 4,876,115 | A * | 10/1989 | Raistrick | 427/115 |
| 5,037,518 | A * | 8/1991 | Young et al. | 204/228.5 |
| 5,334,292 | A * | 8/1994 | Rajeshwar et al. | 205/419 |
| 6,285,816 | B1 * | 9/2001 | Anderson et al. | 385/141 |
| 6,503,382 | B1 * | 1/2003 | Bartlett et al. | 205/67 |
| 7,141,081 | B2 | 11/2006 | Sakai et al. | |
| 7,279,117 | B2 | 10/2007 | Komatsu et al. | |
| 7,449,235 | B2 | 11/2008 | Sawaki et al. | |
| 7,724,501 | B2 | 5/2010 | Ozawa et al. | |
| 2002/0136887 | A1 * | 9/2002 | Penneau et al. | 428/317.9 |

(Continued)

FOREIGN PATENT DOCUMENTS

| | | | |
|---|---|---|---|
| WO | 2005027255 | A1 | 3/2005 |
| WO | 2008070914 | A1 | 6/2008 |
| WO | 2008113133 | A1 | 9/2008 |

OTHER PUBLICATIONS

Hu et al, Pt-Doped .alpha.-Fe2O3 Thin Films Active for Photoelectrochemical Water Splitting, Chemical Materials, vol. 20, No. 12, 2008, pp. 3803-3805.*

(Continued)

*Primary Examiner* — Harry D Wilkins, III

(74) *Attorney, Agent, or Firm* — Armstrong Teasdale LLP

(57) ABSTRACT

Disclosed is an electrolyzer including an electrode including a nanoporous oxide-coated conducting material. Also disclosed is a method of producing a gas through electrolysis by contacting an aqueous solution with an electrode connected to an electrical power source, wherein the electrode includes a nanoporous oxide-coated conducting material.

18 Claims, 14 Drawing Sheets

(56) References Cited

U.S. PATENT DOCUMENTS

| | | | | |
|---|---|---|---|---|
| 2003/0218857 | A1 | 11/2003 | Omori et al. | |
| 2004/0104450 | A1 | 6/2004 | Arai et al. | |
| 2004/0230887 | A1 | 11/2004 | Sellen et al. | |
| 2005/0079418 | A1 | 4/2005 | Kelley et al. | |
| 2007/0224502 | A1 | 9/2007 | Affinito et al. | |
| 2009/0154060 | A1 | 6/2009 | Anderson et al. | |
| 2009/0241496 | A1* | 10/2009 | Pintault | C23C 4/11 55/524 |
| 2009/0314711 | A1* | 12/2009 | Barry | A01K 63/04 210/629 |
| 2010/0213076 | A1* | 8/2010 | McAlister | 205/637 |
| 2010/0304143 | A1* | 12/2010 | Seeber | B01J 2/003 428/404 |
| 2011/0083737 | A1* | 4/2011 | Nishino et al. | 136/256 |
| 2011/0086270 | A1* | 4/2011 | Amos et al. | 429/219 |
| 2012/0149789 | A1* | 6/2012 | Greenbaum | 518/704 |

OTHER PUBLICATIONS

Gorlin et al, A Bifunctional Nonprecious Metal Catalyst for Oxygen Reduction and Water Oxidation, Journal of the American Chemical Society, vol. 132, 2010, pp. 13612-13614.*

Smith et al, Electrodes based on Magneli phase titanium oxides: the properties and application of Ebonex® materials, Journal of Applied Electrochemistry, vol. 28, 1998, pp. 1021-1033.*

Hartmann et al, Mesoporous TiO2: Comparison of Classical Sol-Gel and Nanoparticle Based Photoelectrodes for the Water Splitting Reaction, ACS Nano, vol. 4, No. 6, 2010, pp. 3147-3154.*

Brown et al, Studies of three-dimensional electrodes in the FM01-LC laboratory electrolyser, Journal of Applied Electrochemistry, vol. 24, 1994, pp. 95-106.*

Esswein et al, Size-Dependent Activity of Co3O4 Nanoparticle Anodes for Alkaline Water Electrolysis, Journal of Physical Chemistry C, vol. 113 2009, pp. 15068-15072.*

Gratzel, Michael, Photoelectrochemical cells. Natrue, vol. 414, No. 15, Nov. 2001, pp. 338-344.*

Marshall et al, Nanocrystalline IrxSn(1-x)O2 Electrocatalysts for Oxygen Evolution in Water Electrolysis with Polymer Electrolyte, Journal of New Materials for Electrochemical Systems, No. 7, 2004 (no month), pp. 197-204.*

Gorlin et al, "A Bifunctional Nonprecious Metal Catalyst for Oxygen Reduction and Water Oxidation", Journal of the American Chemical Society, Sep. 2010, vol. 132, No. 39, pp. 13612-13614.*

Trewyn et al, Synthesis and Functionalization of a Mesoporous Silica Nanoparticle Based on the Sol—Gel Process and Applications in Controlled Release, Accounts of Chemical Research, vol. 40, No. 9, Jul. 2007, pp. 846-853.*

Leonard et al, Nanoporous oxide coatings on stainless steel to enable water splitting and reduce the hydrogen evolution overpotential, Internation Journal of Hydrogen Energy, vol. 37, No. 24, Dec. 2012, pp. 18654-18660.*

Lev et al, Sol-Gel Materials in Electrochemistry, Chemistry of Materials, vol. 9, No. 11, Nov. 1997, pp. 2354-2375.*

Ulleberg, O., "Modeling of advanced alkaline electrolyzers: a system simulation approach," Int. J. Hydrogen Energ. 28(1):21-33 (Jan. 2003).

Miller, J.R., "Battery-capacitor power source for digital communication applications: Simulations using advanced electrochemical capacitors," Electrochemical Society Proceedings, Chicago, IL, p. 246-254 (1995).

Jarvis, L.P., et al., "Hybrid power sources for Land Warrior scenario," Ieee Aerospace and Electronic Systems Magazine 15(9):37-41 (Sep. 2000).

Dougal, R.A., et al., "Power and life extension of battery-ultracapcacitor hybrids," Ieee Transactions on Components and Packaging Technologies 25(1):120-131 (Mar. 2002).

Cericola, D., et al., "Simulation of a supercapacitor/Li-ion battery hybrid for pulsed applications," J. Power Sources 195(9):2731-2736 (2010).

Pagano, M., et al., "Hybrid electrochemical power sources for onboard applications," Ieee Transactions on Energy Conversion 22(2):450-456 (Jun. 2007).

Sikha, G., et al., "A mathematical model for a lithium-ion battery/electrochemical capacitor hybrid system," J. Elecrochemical Soc. 152(8):A1682-1693 (2005).

Gao, L.J., et al., "Power enhancement of an actively controlled battery/ultracapacitor hybrid," Ieee Transactions on Power Eiectronics 20(1):236-243 (2005).

Sikha, G., et al., "Performance optimization of a battery-capacitor hybrid system" J. Power Sources 134(1)130-138 (2004).

Wang, X.F., et al., "Application of spherical Ni(OH)(2)/CNTs composite electrode in asymmetric supercapacitor," Transactions of Nonferrous Metals Society of China 16(5):1129-1134 (2006).

Xu, R., et al., "Asymmetric Hybrid Electrochemical Cell/Capacitor," Progress in Chemistry 21(1):235-243 (Jan. 2009) (translated abstract).

Kong, L.B., et al., "Asymmetric Supercapacitor Based on Loose-Packed Cobalt Hydroxide Nanoflake Materials and Activated Carbon," J. Electrochemical Soc. 156(12):A1000-A1004 (2009).

Wang, X.F., "A hybrid metal oxide superacacitor in aqueous KOH elecrolyte," Chinese J. Chem. 24(9):1126-1132 (2006).

Reddy, A.L.M., et al., "Asymmetric flexible supercapacitor stack," Nanoscale Res. Lett. 3(4):145-151 (2008).

Simon, P., et al., "Materials for electrochemical capacitors," Nature Materials 7(11):845-854 (Nov. 2008).

Zang, G., et al., "Preparation of Li4Ti5O12 with Hydration Titanium Dioxide for Electrochemical Hybrid Capacitor," J. Inorganic Materials 24(3):531-534 (May 2009)(translated abstract).

Non-final Office Action received in U.S. Appl. No. 13/149,276, mailed Jun. 20, 2013.

* cited by examiner

NANOPOROUS MATERIALS FOR REDUCING THE OVERPOTENTIAL OF CREATING HYDROGEN BY WATER ELECTROLYSIS

STATEMENT REGARDING FEDERALLY SPONSORED RESEARCH OR DEVELOPMENT

This invention was made with government support under grant number W-31-109-ENG-38 awarded by the Department of Energy. The government has certain rights in the invention.

BACKGROUND OF THE DISCLOSURE

The present disclosure generally relates to electrolyzers including electrodes made of nanoporous oxide-coated conducting material. The electrolyzers are capable of generating gases from aqueous solutions through hydrolysis and other electrochemical reactions. Particularly, in one embodiment, the electrolyzer is capable of generating hydrogen and oxygen from an aqueous solution through water electrolysis.

Thermodynamically, a specific voltage is required to split water to form hydrogen and oxygen. Due to kinetic limitations and activation energies, the actual potential required to split water, however, is greater than the thermodynamic potential. The additional energy requirement to perform the reaction is referred to as the overpotential. The overpotential depends on the catalyst used and/or the electrode materials used in the reaction chamber.

Accordingly, it has been conventionally desirable to find materials that are able to split water with a very low overpotential. Precious metals such as, for example, platinum, are generally considered to have the lowest overpotential.

Given the cost of these precious metals, it would be desirable to find alternative materials and catalysts to lower the overpotential for water oxidation.

Accordingly, there is a need in the art to develop materials able to split water with a very low overpotential. More generally, it would be advantageous to develop alternative materials and catalysts to lower the overpotential for various hydrolysis reactions. These materials may be broadly applicable to reduce the cost of electrode material and to develop alternative energy sources.

SUMMARY OF THE DISCLOSURE

The present disclosure is generally directed to an electrolyzer for use in producing a gas by the method of electrolysis, wherein the overpotential required is reduced as compared to conventional electrolyzers. The electrolyzer includes an electrode comprising a conducting support and a nanoporous oxide coating material. The coating may be considered to be a high band gap material such as $SiO_2$ or $Al_2O_3$ (normally considered to be insulating) or a mid-range band gap material such as $TiO_2$ or $ZrO_2$, which might be considered a semiconducting material.

In one aspect, the present disclosure is directed to an electrolyzer comprising a housing, an electrode, and an electrical power source, the electrode including a conducting material coated with a nanoporous oxide. The nanoporous oxide is selected from the group consisting of silicon dioxide, zirconium oxide, titanium oxide, aluminum oxide, magnesium oxide, magnesium aluminum oxide, tin oxide, lead oxide, iron oxide, manganese oxide, and combinations thereof including metal doped oxides. The conducting material is selected from the group consisting of a porous carbon, a nonporous carbon, a porous metal, a nonporous metal, a porous polymer, a nonporous polymer, and combinations thereof.

In another aspect, the present disclosure is directed to a method of producing a gas. The method includes contacting an aqueous solution with an electrode connected to an electrical power source, the electrode including a conducting material coated with a nanoporous oxide; and applying a voltage from the electrical power source to the electrode.

In still another aspect, the present disclosure is directed to a method of producing hydrogen and oxygen by electrolysis. The method includes contacting an aqueous solution with an electrode connected to an electrical power source, the electrode including a conducting material coated with a nanoporous oxide; and applying a voltage from the electrical power source to the electrode.

BRIEF DESCRIPTION OF THE DRAWINGS

The disclosure will be better understood, and features, aspects and advantages other than those set forth above will become apparent when consideration is given to the following detailed description thereof. Such detailed description makes reference to the following drawings, wherein.

Figure 1A:
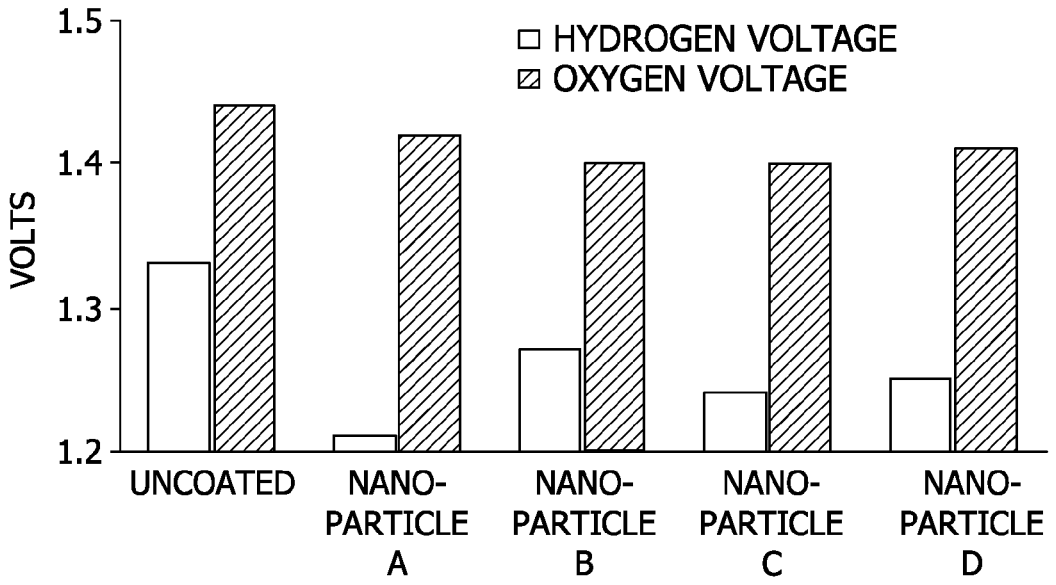
FIG. 1A shows the voltage required (relative to a saturated calomel reference) to produce both hydrogen and oxygen using electrodes including conducting material coated with an aluminum oxide coating (Nanoparticle A), a silicon dioxide coating (Nanoparticle B), a titanium oxide coating (Nanoparticle C), or a zirconium oxide coating (Nanoparticle D). Manganese oxides could also be used.

While the disclosure is susceptible to various modifications and alternative forms, specific embodiments thereof have been shown by way of example in the drawings and are herein described below in detail. It should be understood, however, that the description of specific embodiments is not intended to limit the disclosure to cover all modifications, equivalents and alternatives falling within the spirit and scope of the disclosure as defined by the appended claims.

DETAILED DESCRIPTION

Unless defined otherwise, all technical and scientific terms used herein have the same meaning as commonly understood by one of ordinary skill in the art to which the disclosure belongs. Although any methods and materials similar to or equivalent to those described herein may be used in the practice or testing of the present disclosure, suitable methods and materials are described below.

In accordance with the present disclosure, it has now been found that improved electrolyzers can be made to more efficiently and effectively produce gas from aqueous solutions. Particularly, by including one or more electrodes having nanoporous oxide-coated conducting materials in the electrolyzer of the present disclosure, the overpotential required to produce a gas from an aqueous solution by electrolysis may be reduced. Advantageously, the electrolyzers including the electrodes having nanoporous oxide-coated conducting material of the present disclosure allow for the production of gases from a solution using significantly reduced overpotential, without requiring rare, costly precious metals. Further, these gases can be produced without adding any alkaline catalysts and may be operated at ambient temperatures.

Electrolyzer

In one aspect, the present disclosure is directed to an electrolyzer. The electrolyzer includes one or more electrodes as set forth herein having a nanoporous oxide-coated conducting material, a housing adapted to surround the electrodes, an electrical power source. At least two of the electrodes are connected to the electrical power source such as through electrical connectors known in the art.

The electrolyzer of the present disclosure may be prepared using any number of electrodes including conducting material coated with a nanoporous oxide. For example, suitably, the electrolyzer includes two electrodes, more suitably, three electrodes, more suitably, four electrodes, more suitably, five electrodes, and even more suitably ten electrodes or more electrodes. In one particularly, preferred embodiment, the electrolyzer includes eleven electrodes. In another embodiment, the electrolyzer includes twenty-one electrodes.

The housing is sized and configured to receive the electrodes, an aqueous solution, and electrical connections. The housing is also configured to include plumbing.

The housing may be made from any material that is able to withstand heat, degradation, and/or deformation resulting from the electrolysis reaction. For example, the housing may be made of polyphenylene sulfide, high-temperature resistance nylons, and other suitable plastic materials. A particularly suitable plastic material can be polyethylene. In one embodiment, the housing may further include a metal plate such as, for example, a steel plate, surrounding an inner housing material made of polyphenylene sulfide, high-temperature resistance nylons, and other suitable plastic materials for protection, aesthetic, and other reasons. Although it is generally desirable that the housing be formed from lightweight materials, the exact material utilized to form the housing is not narrowly critical as long as is it capable of withstanding the electrolysis conditions.

The electrical power source is not narrowly critical as long as it provides sufficient voltage for the electrolysis reaction. In one embodiment, the power source is a battery (lead-acid or any other type). The voltage range of the power source will depend on the total number of electrodes and the current range will depend on the size of the electrodes.

Figure 12:
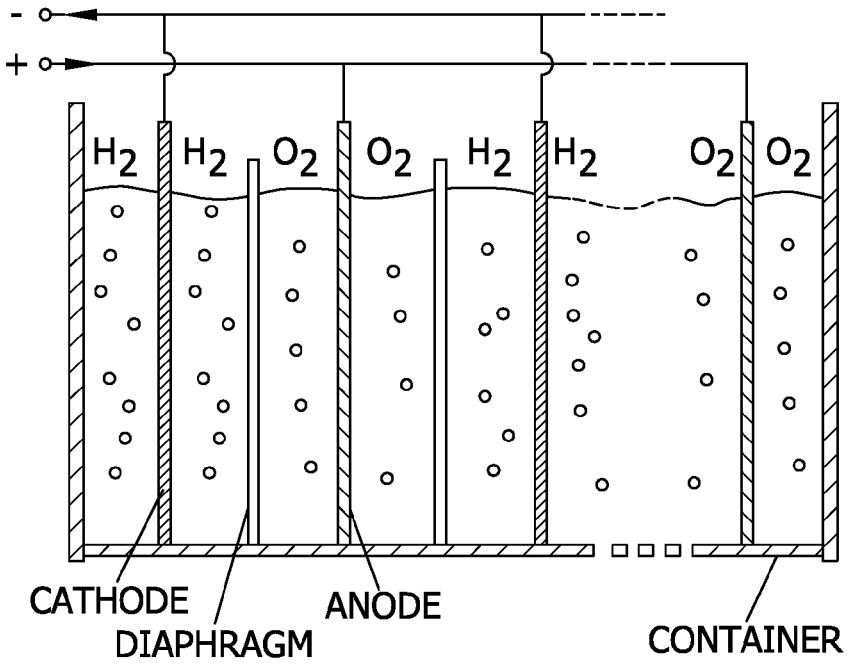
FIG. 12 is an illustration showing the principles of a monopolar electrolyzer design.

Typically, the electrical power source is connected to at least two electrodes. For example, in one embodiment, at least two electrodes are connected to the electrical power source. Any number of configurations may be used to connect the at least two electrodes to the electrical power source. For example, in one embodiment, an electrolyzer has 21 electrodes, wherein five of the 21 electrodes are connected to the power source (shown as points A-E in FIG. 12). In another embodiment, an electrolyzer having 11 electrodes may be configured wherein two electrodes (one positive and one negative) are connected to the electrical power source. In yet another embodiment, an electrolyzer having 11 electrodes may be configured wherein three electrodes (two positive and one negative) are connected to the electrical power source. One skilled in the art would understand that the electrical connection configurations can differ from the above-described embodiments without departing from the scope of the present disclosure.

The aqueous solution may be an electrolyte-containing aqueous solution including an organic or inorganic acid, an organic or inorganic base, or an organic or inorganic salt. Suitable aqueous solutions may include an electrolyte-forming substance including electrolytes resulting from phosphoric acid, potassium chloride, sodium perchlorate, sodium chloride, lithium chloride, lithium nitrate, potassium nitrate, sodium nitrate, sodium hydroxide, potassium hydroxide, lithium hydroxide, ammonium hydroxide, ammonium chloride, ammonium nitrate, lithium perchlorate, calcium chloride, magnesium chloride, hydrochloric acid, nitric acid, sulfuric acid, potassium perchlorate, sodium phosphate, disodium hydrogen phosphate, monosodium phosphate, and combinations thereof.

Electrodes of the Electrolyzer

Conducting Material

In one aspect, the present disclosure is directed to an electrode including conducting material coated with a nanoporous oxide. Suitable conducting materials for use in the electrodes may be, for example, conducting carbon, conducting metals, conducting polymers, and combinations thereof.

In another embodiment, the conducting materials may be mixtures of conducting carbon materials, conducting metals, and conductive polymers. Suitable mixtures may be, for example, carbon-metal, carbon-polymer, metal-polymer, and carbon-metal-polymer mixtures. Additional mixtures may be, for example, mixtures of porous and nonporous carbon, porous and nonporous metals, and porous and nonporous polymers and combinations thereof.

A. Conducting Carbon

In one embodiment, the conducting material may be a conducting carbon. The conductivity of the conducting carbon may be from about $10^{-6}$ S/m to about $10^{7}$ S/m or more. Conducting carbon may be obtained from commercial suppliers such as Calgon Carbon, Carbon Chem, Shell Carbon, Hollingsworth and Vose. Both non-porous and porous conducting carbons as known in the art are suitable for use in the electrodes. For example, activated carbon, single-wall carbon nanotubes, multi-wall carbon nanotubes, and graphene may be suitable conducting carbons.

Suitable porous carbon may have a surface area of from about 1 $m^2/g$ to about 2000 $m^2/g$. More suitably, the surface area of the porous carbon may be from about 30 $m^2/g$ to about 1500 $m^2/g$.

In yet other embodiment, a mixture of carbon may be used as the conducting carbon in the electrode. For example, a higher surface area porous carbon may be mixed with a higher conductivity carbon such as graphite, acetylene black or graphene.

B. Conductive Metal

In other embodiments, the conducting material may be any conducting metal known in the art, as well as combinations of conducting metals. Suitable conducting metals may be, for example, titanium, stainless steel, aluminum, iron, nickel, platinum, gold, palladium, silver, and combinations thereof. Particularly suitable conductive metals may be non-precious metals such as, for example, titanium, stainless steel, aluminum, nickel, iron, and combinations thereof. Both porous and non-porous conductive metals may be used in the electrodes. Porous conductive metals may be obtained from commercial suppliers such as Mott Corporation.

C. Conductive Polymers

In still other embodiments, the conducting material may be conductive polymers. As used herein, the term "conductive polymers" is used according to its ordinary meaning as understood by those skilled in the art to refer to organic polymers that conduct electricity. Suitable polymers may be, for example, polyaniline, polypyrrole, polythiophenes, polyethylenedioxythiophene, poly(p-phenylene vinylene)s, and combinations thereof. In some embodiments, the conductive polymers may be doped using an oxidation-reduction process such as, for example, by chemically doping and electrochemical doping, as understood by those skilled in the art.

Nanoporous Oxide Coating

In another aspect, a nanoporous oxide coating is applied to, and suitably, coated on, the conducting material of the electrode. Suitable nanoporous oxides for use in the coating may be, for example, silicon dioxide ($SiO_2$), zirconium oxide (also referred to as zirconium dioxide and $ZrO_2$), titanium oxide ($TiO_2$), aluminum oxide ($Al_2O_3$), manganese oxide (MnO, $Mn_3O_4$, $Mn_2O_3$, $MnO_2$, $Mn_2O_7$), magnesium oxide (MgO), zinc oxide (ZnO), tin oxide (SnO), lead oxide (PbO), iron oxide ($Fe_2O_3$), and combinations thereof. Suitable oxides may be those wherein the other atom in the oxide is selected from beryllium, manganese, magnesium, calcium, strontium, barium, radium, titanium, zirconium, hafnium, zinc, cadmium, mercury, boron, aluminum, gallium, indium, thallium, carbon, silicon, germanium, tin, lead, and combinations thereof. Depending on the desired gas, those skilled in the art can select a suitable nanoporous oxide coating to coat the conducting material. For example, if the desired gas is hydrogen gas, titanium oxide is an exemplary suitable nanoporous oxide coating. If the desired gas is oxygen gas, silicon oxide is an exemplary suitable nanoporous oxide coating.

In another embodiment, the nanoporous oxide coating may be doped with metals. The terms "doped" and "doping" are used interchangeably herein according to their ordinary meanings as understood by those skilled in the art to refer to the addition of metal materials to the nanoporous oxide coating. Suitable metals that may be used to dope the nanoporous oxide coating may be, for example, titanium, aluminum, nickel, iron, tungsten, platinum, gold, palladium, silver, and combinations thereof. Suitable amounts of metal used to dope the nanoporous oxide coating may be, for example, may be up to about 5% by weight is possible. In one embodiment, the nanoporous oxide coating is doped with about 0.1% by weight to about 5% by weight metal.

The nanoporous oxide coating may be porous or nonporous. Suitable average pore diameter size of the nanoporous oxide coating may be from about 0.01 nm to about 500 nm. A particularly suitable average pore size diameter may be from about 0.3 nm to about 25 nm. The porosity of the nanoporous oxide coating can be controlled according to the methods and conditions used to apply the coating as described herein. The nanoporous oxide coating may be applied to the electrode by any suitable method known by those skilled in the art. Suitable application methods may include, for example, chemical vapor deposition, dip-coating, electrodeposition, imbibing, plasma spray-coating, spin coating, sputter-coating, slip casting, spray-coating, and combinations thereof.

The nanoporous oxide coating is typically prepared using sol-gel chemistry methods. Typically, the sol-gel suspension is made by adding a metal alkoxide with water in either acidic or basic conditions. The metal alkoxide then undergoes hydrolysis and condensation reactions, which form the oxide nanoparticles. The suspension, including the nanoporous oxide nanoparticles, is then applied to the conducting material by contacting the suspension to the conducting material according to any method such as, for example, chemical vapor deposition, sputtering, plasma spray, spray coating, spin coating, dip coating, slip casting, imbibing, electrodeposition, and combinations thereof. If desired, application of the nanoporous oxide may be applied using scintering (firing) temperatures from about 100° C. to 1500° C. Particularly suitable firing temperatures may be from about 300° C. to about 500° C. Even more suitable firing temperatures may be from about 350° C. to about 450° C.

The conditions in which the nanoporous oxide coating is applied may be adjusted by those skilled in the art to achieve a desired coating characteristic. Such coating characteristics may include, for example, porosity of the coating, thickness of the coating, number of coatings (also referred to herein as layers), and combinations thereof. Conditions that may be adjusted may include, for example, temperature, particle size of the nanoporous oxide in suspension, concentration of the suspension, pH of the suspension, and combinations thereof.

The amount of nanoporous oxide coating applied to the conducting material depends on the nanoporous oxide coating to be applied and the type of conducting material. Suitable amounts may be, for example, from about 1% by weight to about 50% by weight. Particularly suitable amounts may be, for example, from about 1% by weight to about 40% by weight. Even more suitable amounts may be, for example, from about 1% by weight to about 30% by weight. Even more suitable amounts may be, for example, from about 1% by weight to about 25% by weight.

Any number of nanoporous oxide coating layers may be applied to the conducting material. As used herein, the terms "coats", "coatings", and "layers" are used interchangeably. A suitable number of nanoporous oxide coating layers may be, for example, one or more. A particularly suitable number of nanoporous oxide coating layers may be from 1 to 5 layers. The number of the nanoporous oxide coating layers can be controlled according to the methods and conditions used to apply the coatings and the conditions described herein. It should be understood that the nanoporous oxide coating may partially and/or completely coat the conducting support, however, completely coating the support is particularly desirable.

A nanoporous oxide coating layer may be of any thickness known as suitable by those skilled in the art. A particularly suitable thickness may be from about 0.01 μm to about 50 μm. An even more suitable thickness may be from about 0.1 nm to about 10 nm. The thickness of the nanoporous oxide coating layer may be controlled according to the methods and conditions used to apply the coating layer as described herein. In some embodiments, the thicknesses of individual nanoporous oxide coating layers may be varied such that different layers of the nanoporous oxide coating may have different thicknesses.

Method of Producing a Gas Using the Electrolyzer

In another aspect, the present disclosure is directed to a method of producing a gas by electrolysis. The method includes contacting an aqueous solution with an electrode having a nanoporous oxide-coated conducting material and being connected to an electrical power source; and applying a voltage from the electrical power source to the electrode.

Gases that may be produced according to the method may be, for example, hydrogen, chlorine, oxygen, bromine, fluorine, and combinations thereof.

The electrode may be any one of the electrodes having a nanoporous oxide-coated conducting material as described herein.

The aqueous solution may be an aqueous solution as described herein. Suitable aqueous solutions may be, for example, an inorganic or organic acid, an inorganic or organic base, an inorganic or an organic salt, and combinations thereof. Particularly suitable aqueous solutions may be an electrolyte-containing aqueous solution comprising an electrolyte selected from the group consisting of phosphoric acid, potassium chloride, sodium perchlorate, sodium chloride, lithium chloride, lithium nitrate, potassium nitrate, sodium nitrate, sodium hydroxide, potassium hydroxide, lithium hydroxide, ammonium hydroxide, ammonium chloride, ammonium nitrate, lithium perchlorate, calcium chloride, magnesium chloride, hydrochloric acid, nitric acid, sulfuric acid, potassium perchlorate, sodium phosphate, disodium hydrogen phosphate, monosodium phosphate, and combinations thereof.

The aqueous solution may be at any pH. The pH of the aqueous solution may be adjusted for the gas to be produced and/or the voltage to be applied by the electrical power source to the electrodes of the electrolyzer.

Any suitable method may be used to contact the aqueous solution with the electrode. For example, the electrode may be submerged in the aqueous solution. In a particularly preferred embodiment, the aqueous solution is pumped into the housing, for example air pumps or the like. In yet another preferred embodiment, the aqueous solution may be gravity fed or be circulated by convection. The housing may include an input port wherein the aqueous solution enters the housing and an output port wherein the aqueous solution and gas exits the housing.

The disclosure will be more fully understood upon consideration of the following non-limiting Examples.

EXAMPLE 1

In this Example, the voltage required to produce hydrogen and oxygen by water hydrolysis using electrolyzers with electrodes including nanoporous oxide coatings was tested. The amount of hydrogen and oxygen produced was also measured.

The electrolyzer was operated using a multichannel potentiostat (an instrument that can accurately measure and source voltages and currents) to monitor the current and voltage between all the electrodes.

Suspensions of nanoporous oxides were prepared by mixing metal alkoxides with water in either acidic or basic conditions to produce suspension of aluminum oxide, silicon dioxide, titanium oxide, and zirconium oxide in water. Electrodes were then prepared by coating a 2"×2" stainless steel coupon with one layer of the nanoporous oxide coating solutions by a dip coating technique where the coupon was withdrawn from the suspension at a controlled velocity. The coated electrode samples (i.e., coupons) were then fired at a scintering temperature of 350° C. Experiments were performed in a three-electrode configuration containing a platinum counter electrode and a standard calomel reference electrode so the voltage of each reaction could be measured accurately. The three-electrode configuration used together with linear sweep voltammetry allowed for independent measurement of the voltage required to produce hydrogen and oxygen. The electrolyte-containing aqueous solution used in the Example was 1M $Na_2SO_4$ at pH 6.8.

Figure 1B:
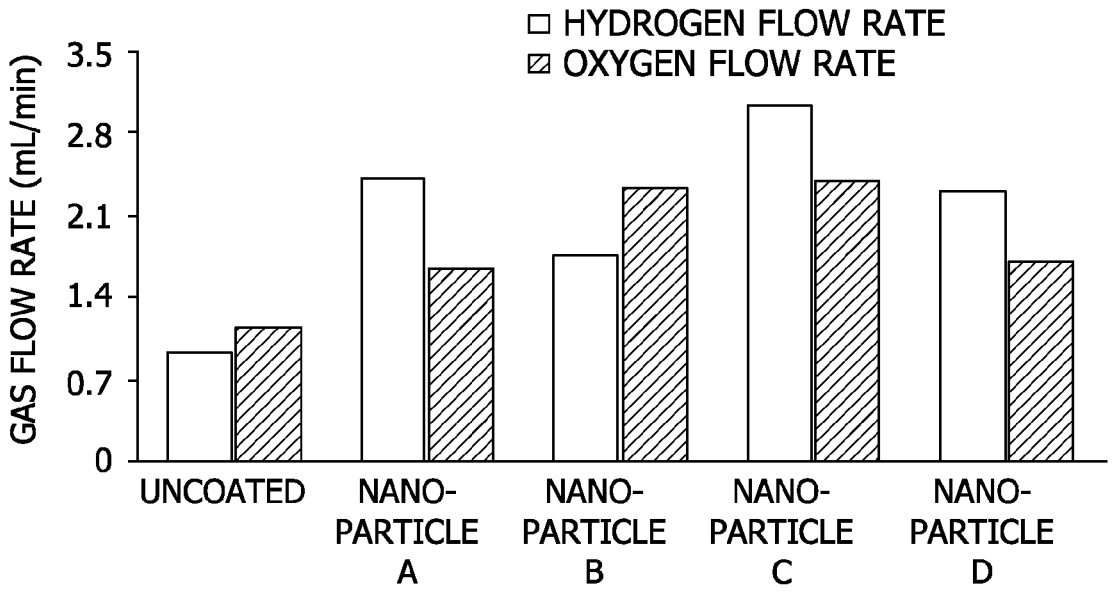
FIG. 1B shows the hydrogen and oxygen gas flow rate using electrodes including conducting material coated with an aluminum oxide coating (Nanoparticle A), a silicon dioxide coating (Nanoparticle B), a titanium oxide coating (Nanoparticle C), or a zirconium oxide coating (Nanoparticle D).

As shown in FIG. 1A, the voltage required (relative to a saturated calomel reference) to produce both hydrogen and oxygen for each of the different coatings was reduced as compared to the uncoated control. Thus, the nanoporous oxide coatings reduced the overpotential of both the hydrogen and oxygen reactions. A greater effect of reducing the overpotential was observed for the hydrogen reaction. As shown in FIG. 1B, the same voltage produced an increase in the gas flow rate of both hydrogen and oxygen as compared to the uncoated control.

Current measurements were used to estimate hydrogen and oxygen flow rates. Under these conditions, titanium oxide (Nanoparticle C) produced the most hydrogen and oxygen. It was possible to obtain up to 3 times the flow rate of hydrogen and oxygen using electrodes with a nanoporous oxide coating.

EXAMPLE 2

In this Example, the effect of varying the number of nanoporous oxide coatings and the sintering temperature on overpotential was evaluated.

Stainless steel coupons (2"×2") were coated with either 1 or 3 layers of nanoporous oxide coating at sintering temperatures of either 350° C. or 450° C. A three electrode configuration with a platinum counter electrode and linear sweep voltammetry was used, as previously described. The electrolyte-containing aqueous solution used in the Example was 1M $Na_2SO_4$ at pH 6.8.

Figure 2:
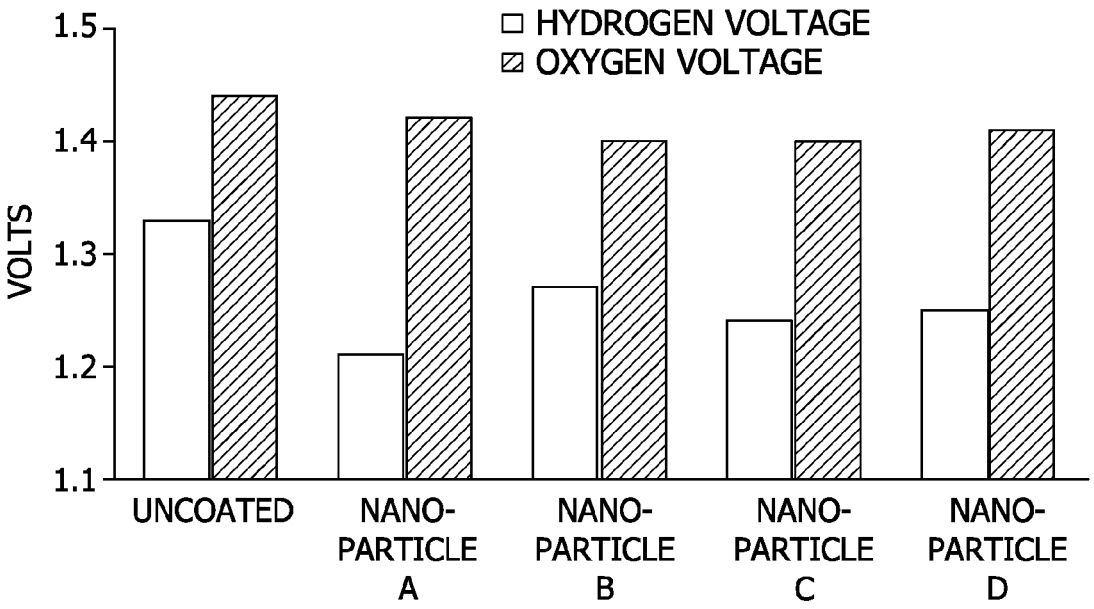
FIG. 2 shows the voltage required (relative to a saturated calomel reference) to produce both hydrogen and oxygen using electrodes including conducting material coated with one nanoporous oxide layer fired at a sintering temperature of 350° C.
Figure 3:
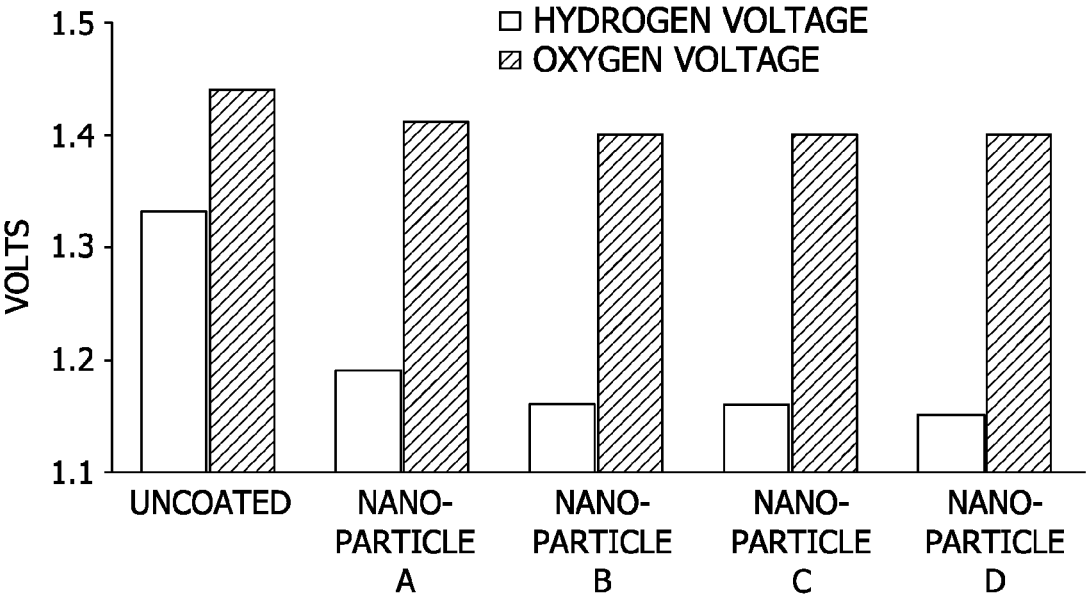
FIG. 3 shows the voltage required (relative to a saturated calomel reference) to produce both hydrogen and oxygen using electrodes including conducting material coated with three nanoporous oxide layers fired at a sintering temperature of 350° C.
Figure 4:
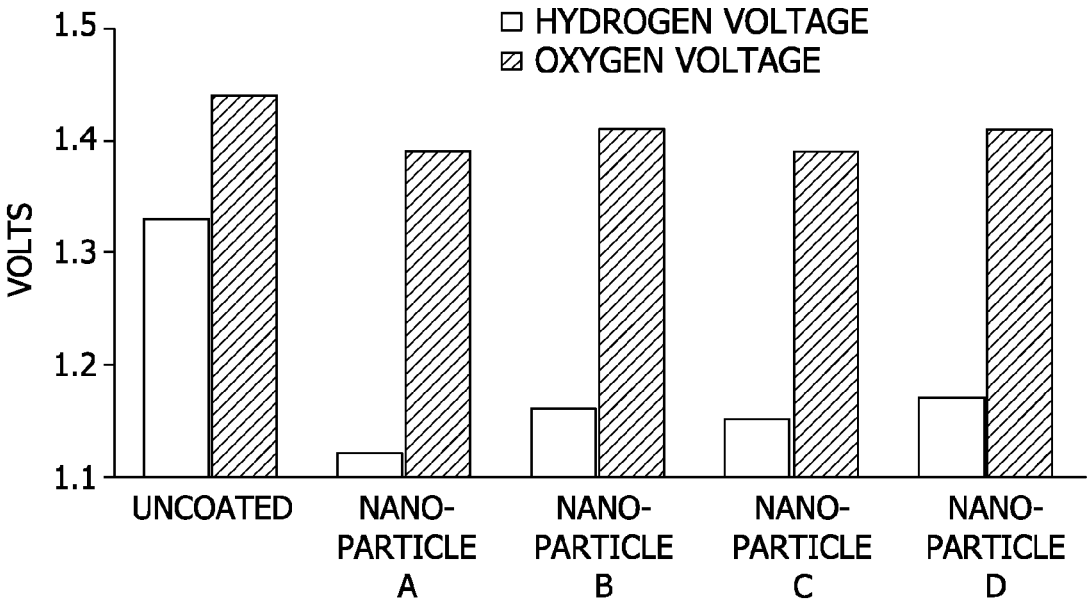
FIG. 4 shows the voltage required (relative to a saturated calomel reference) to produce both hydrogen and oxygen using electrodes including conducting material coated with one nanoporous oxide layer fired at a sintering temperature of 450° C.
Figure 5:
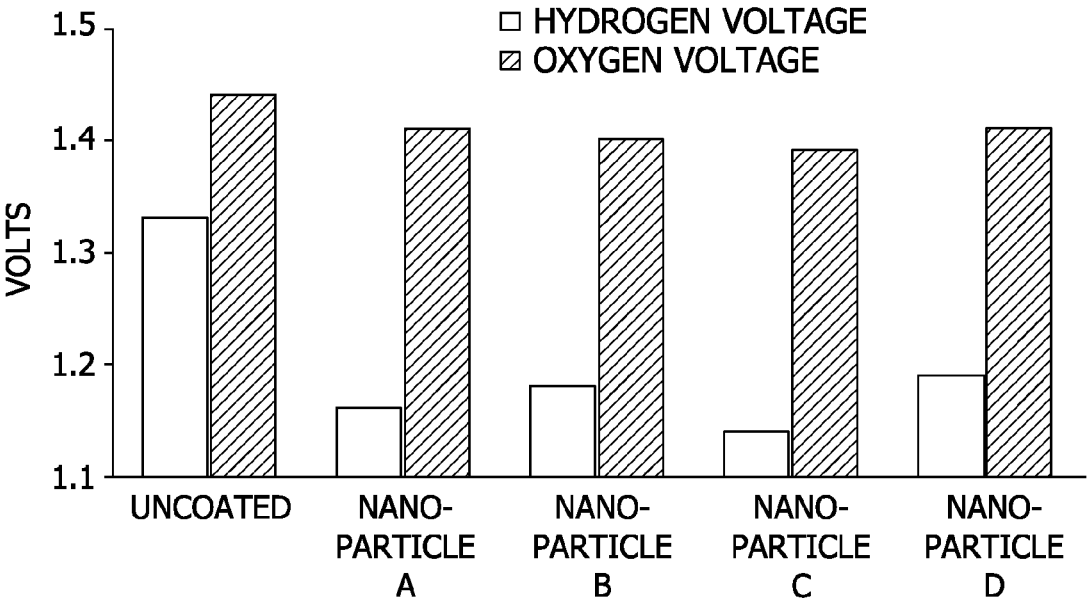
FIG. 5 shows the voltage required (relative to a saturated calomel reference) to produce both hydrogen and oxygen using electrodes including conducting material coated with three nanoporous oxide layers fired at a sintering temperature of 450° C.
Figure 6:
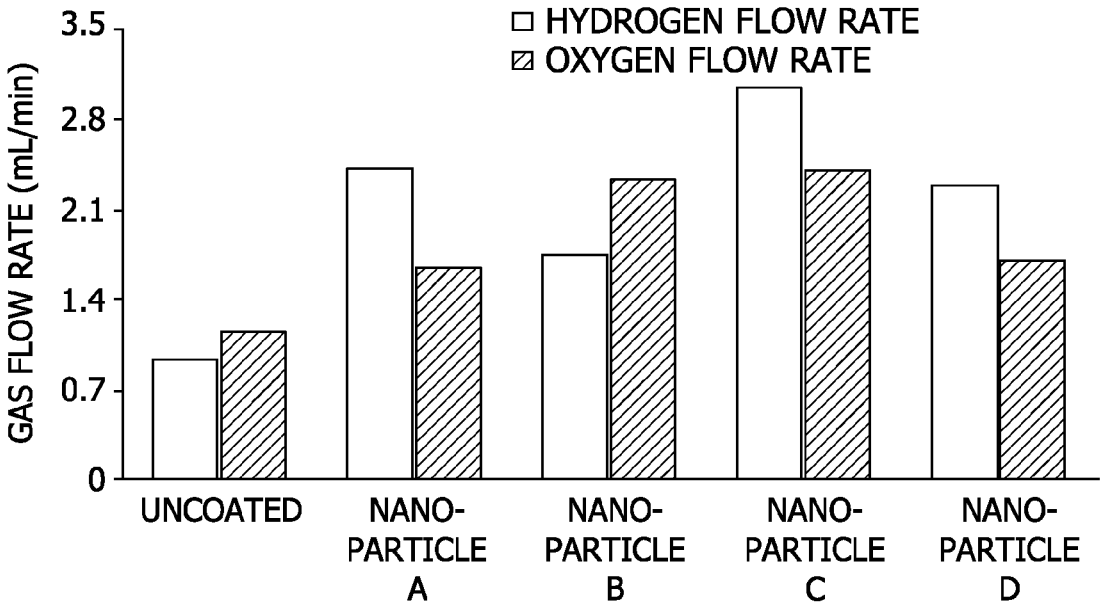
FIG. 6 shows the flow rates of hydrogen and oxygen produced using electrodes including conducting material coated with one nanoporous oxide layer fired at a sintering temperature of 350° C.
Figure 7:
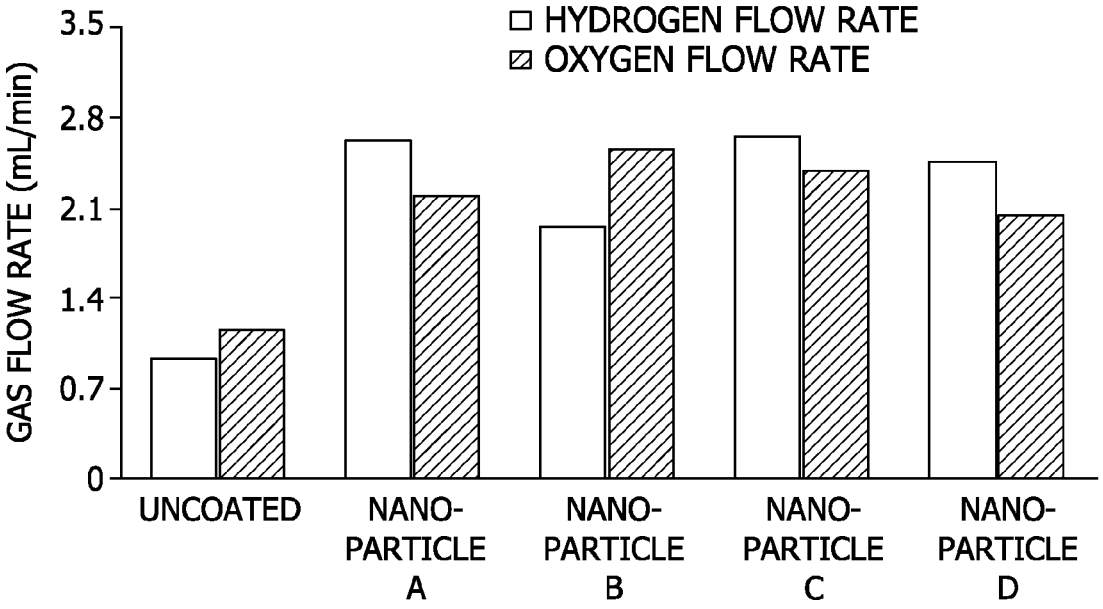
FIG. 7 shows the flow rates of hydrogen and oxygen produced using electrodes including conducting material coated with three nanoporous oxide layers fired at a sintering temperature of 350° C.
Figure 8:
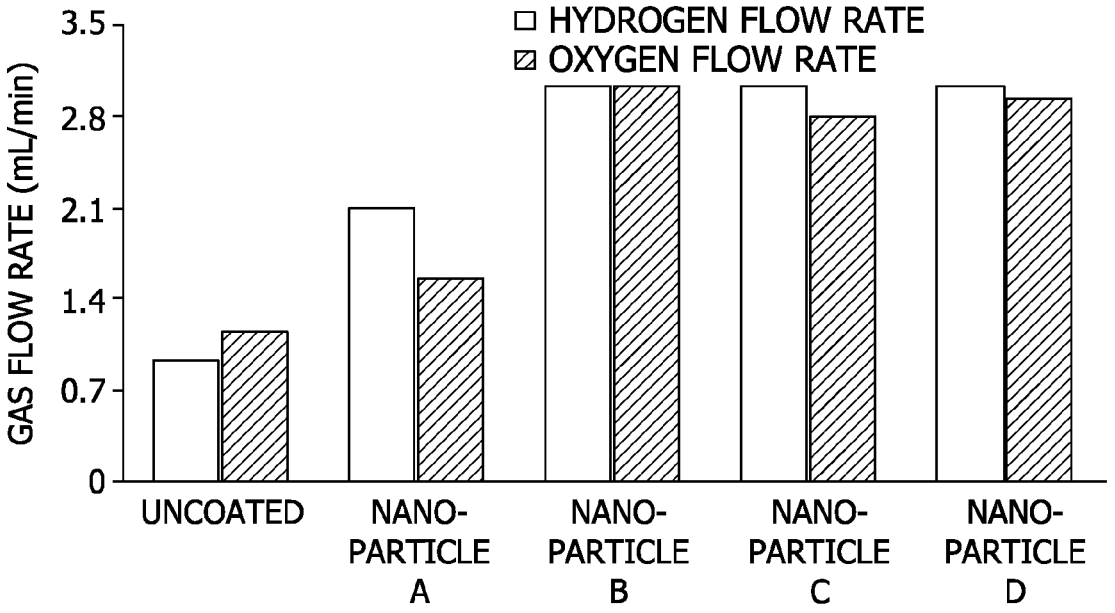
FIG. 8 shows the flow rates of hydrogen and oxygen produced using electrodes including conducting material coated with one nanoporous oxide layer fired at a sintering temperature of 450° C.
Figure 9:
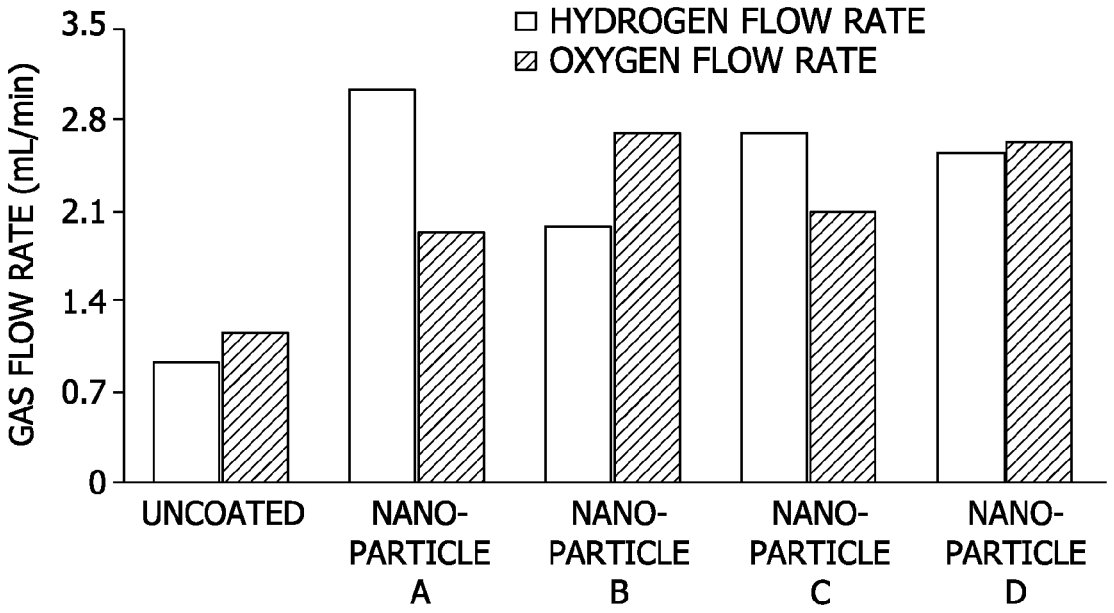
FIG. 9 shows the flow rates of hydrogen and oxygen produced using electrodes including conducting material coated with three nanoporous oxide layers fired at a sintering temperature of 450° C.

FIG. 2 shows the voltage required (relative to a saturated calomel reference) to produce both hydrogen and oxygen for electrodes with 1 layer of coating fired at a sintering temperature of 350° C. FIG. 3 shows the voltage required (relative to a saturated calomel reference) to produce both hydrogen and oxygen for electrodes with 3 layers of coating fired at a sintering temperature of 350° C. FIG. 4 shows the voltage required (relative to a saturated calomel reference) to produce both hydrogen and oxygen for electrodes with 1 layer of coating fired at a sintering temperature of 450° C. FIG. 5 shows the voltage required (relative to a saturated calomel reference) to produce both hydrogen and oxygen for electrodes with 3 layers of coating fired at a sintering temperature of 450° C.

The hydrogen overpotential was lower for 3 layers of coating than for 1 layer of coating fired at 350° C. The hydrogen overpotential was even lower for 1 layer of coating fired at 450° C. as compared to 1 and 3 layers of coating fired at 350° C. There was little change in the hydrogen overpotential between 1 layer of coating and 3 layers of coating fired at 450° C. There was not an appreciable decrease in the oxygen overpotential when more coats were added or when fired at a higher temperature.

The current measurements were also used to estimate the hydrogen and oxygen flow rates. As shown in FIGS. 6-9, it was possible to obtain over 3 times the flow rate of hydrogen and oxygen with the electrodes including conductive materials coated with nanoporous oxide.

EXAMPLE 3

Figure 10:
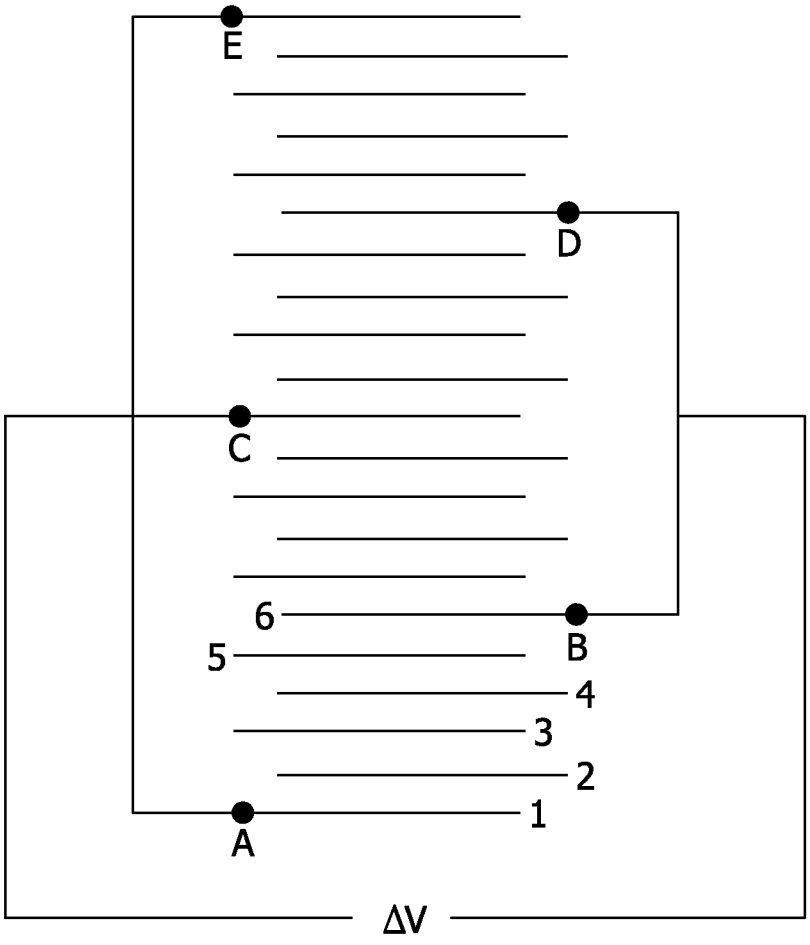
FIG. 10 is a diagram illustrating an electrolyzer with 21 electrodes having five electrodes connected to an electrical power source.

In this Example, voltage between unconnected electrodes was measured to determine if reactions were occurring on the electrodes not connected to the power source. In the standard configuration, only 5 of the 21 electrodes in the electrolyzer were connected to a power source, as illustrated in FIG. 10.

In this Example, the voltage and currents were measured using a multichannel potentiostat to determine how the voltage and currents are distributed between electrodes of an electrolyzer. One channel of the multichannel potentiostat was used to source the electrical energy to the electrolyzer and four other channels were used to measure the voltage across the connected channel. A set voltage of 11 V remained constant throughout the Example.

Figure 11:
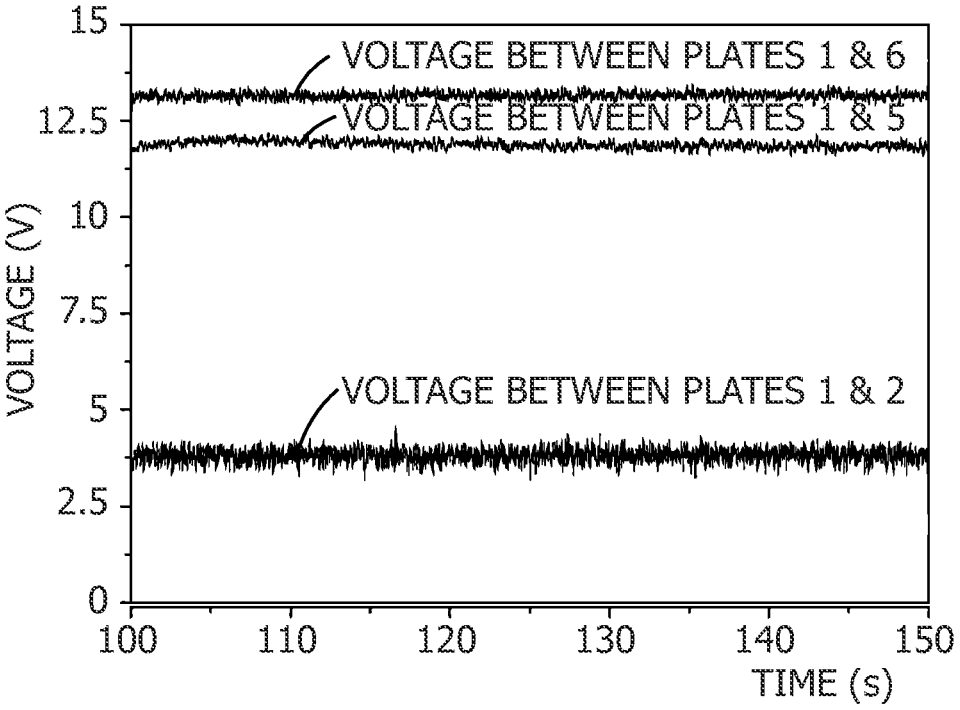
FIG. 11 shows the voltage as a function of time for unconnected electrodes in the electrolyzer.

As shown in FIG. 11, measurements of the voltage difference between plates 1 and 2, and plates 1 and 5 were obtained even though plates 2 and 5 were not connected to the power source. The voltage increased stepwise, which is analogous to batteries connected in series. These results indicate that even though plates 2 and 5 were not connected to the power source, there appeared to be an electrical series between them.

Figure 13:
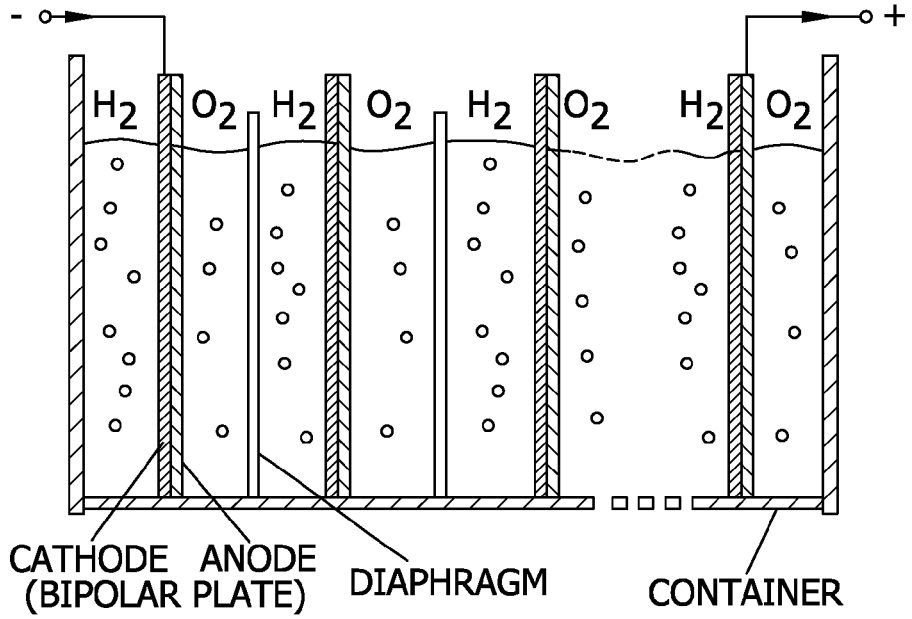
FIG. 13 is an illustration showing the principles of a bipolar electrolyzer design.

These results appear to show that the system of the present disclosure is a combination of a bipolar and monopolar electrolyzer with 5 of the 21 electrodes connected to the power source. It is generally considered that to have more gas production in less volumetric space, biopolar plates are required. However, using the methods of the present disclosure allow for a different layer on either side of the plate, thus favoring the oxidation or reduction reaction. In a monopolar design, each electrode is connected to either the positive or negative terminal of the power source in an alternating fashion (FIG. 12) and hydrogen is produced on both sides of the electrodes that are connected to the negative terminal while oxygen is produced on both sides of the electrodes that are connected to the positive terminal In a bipolar design, only the end electrodes are connected to the power source (FIG. 13). However, reactions occur on the electrodes that are not connected and both oxidation and reduction occur on the same electrode and hydrogen is produced on one side of the electrode and oxygen is produced on the other side. Also, in a true bipolar electrode, each side of the electrode is made from a different material or has two different types of coatings applied.

Results of this Example indicated that the electrolyzer system of the present disclosure seemed to function as a combined monopolar and bipolar electrolyzer even though the electrodes were made from only one material.

EXAMPLE 4

Figure 14:
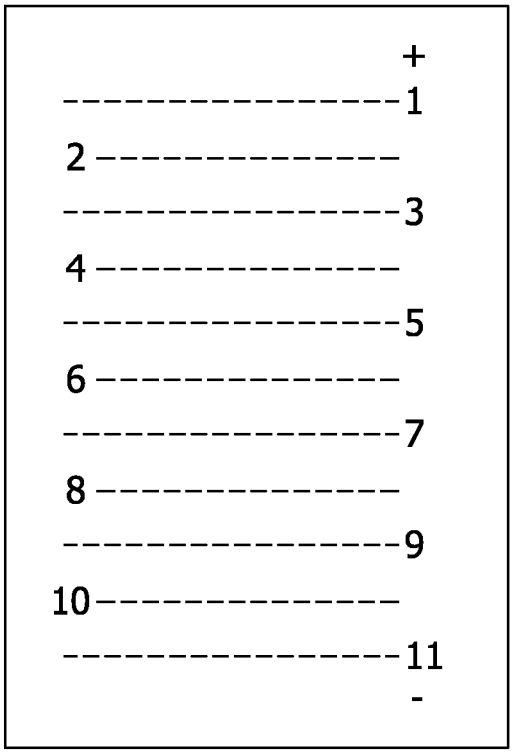
FIG. 14 shows the wiring configuration of an electrolyzer as evaluated in Example 4.

In this Example, different wiring configurations of an electrolyzer were evaluated. An 11 cell electrolyzer was used in which burets were connected to the electrolyzer to measure the amount of gas generated. Tests were conducted with two end electrodes connected (in a true bipolar configuration) with one of the end electrodes (electrode 1) connected to the positive terminal and the other end electrode (electrode 11) connected to the negative terminal, three electrodes connected where the positive terminal was connected to the two end electrodes (electrodes 1 and 11) and the negative terminal was connected to a middle electrode (electrode 7), four electrodes connected (in an in/out configuration) with the positive terminal connected to the two end electrodes (electrodes 1 and 11) and the negative terminals connected to electrodes evenly spaced between the positive electrodes (electrodes 4 and 8), four electrodes connected (in an alternating configuration) with the positive terminal connected to electrodes 1 and 8 and the negative terminal connected to electrodes 4 and 11, and five electrodes connected where the positive terminal was connected to electrodes 1, 5, and 11 and the negative terminal was connected to electrodes 4 and 8. The above-described configurations are shown in FIG. 14. The gas flow rate was measured directly from the electrolyzer using the burets and the potentiostat was used to measure the amount of power supplied to the electrolyzer.

Efficiency of the systems was calculated by determining the amount of energy (in Joules) needed to produce one milliliter of gas.

Results are summarized in Table 1, no gain in efficiency appeared when either two electrodes were connected or three electrodes were connected.

TABLE 1

Flow rate, Power, and Efficiency for Electrode configurations.

| | Test 1 | Test 2 | Test 3 | Test 4 | Average |
|---|---|---|---|---|---|
| | Two Electrodes Connected - True Bipolar | | | | |
| Flow Rate (mL/s) | 0.93 | 0.85 | 0.94 | 0.88 | 0.90 |
| Power (W) | 12.15 | 11.51 | 12.05 | 11.71 | 11.85 |
| Efficiency (J/mL) | 13.01 | 13.58 | 12.85 | 13.37 | 13.21 |
| | Three Electrodes Connected | | | | |
| Flow Rate (mL/s) | 0.28 | 0.26 | 0.24 | | 0.26 |
| Power (W) | 3.70 | 3.60 | 3.50 | | 3.60 |
| Efficiency (J/mL) | 13.41 | 13.84 | 14.45 | | 13.90 |
| | Four Electrodes Connected - In/Out Configuration | | | | |
| Flow Rate (mL/s) | 0.54 | 0.41 | 0.43 | | 0.46 |
| Power (W) | 4.64 | 4.64 | 4.64 | | 4.64 |
| Efficiency (J/mL) | 8.6 | 11.24 | 10.75 | | 10.20 |
| | Four Electrodes Connected - Alternating Configuration | | | | |
| Flow Rate (mL/s) | 0.42 | 0.4 | 0.42 | | 0.41 |
| Power (W) | 4.84 | 4.98 | 4.9 | | 4.91 |
| Efficiency (J/mL) | 11.48 | 12.38 | 11.63 | | 11.83 |
| | Five Electrodes Connected | | | | |
| Flow Rate (mL/s) | 0.13 | 0.11 | 0.12 | | 0.12 |
| Power (W) | 1.26 | 1.24 | 1.28 | | 1.26 |
| Efficiency (J/mL) | 9.75 | 11.83 | 10.97 | | 10.85 |

EXAMPLE 5

In this Example, the effect of the pH of the aqueous solution used in the electrolyzer was evaluated. Electrodes were prepared with 1 layer of an aluminum oxide coating (Nanoparticle A), a silicon dioxide coating (Nanoparticle B), a titanium oxide coating (Nanoparticle C), or a zirconium oxide coating (Nanoparticle D) fired at a temperature of 450° C. 1M $Na_2SO_4$ solutions were tested under acidic conditions (pH 2.25), neutral conditions (pH 6.8), or basic conditions (pH 11.75). Linear sweep voltammetry was used to independently measure the voltage required to produce hydrogen and oxygen.

Figure 15:
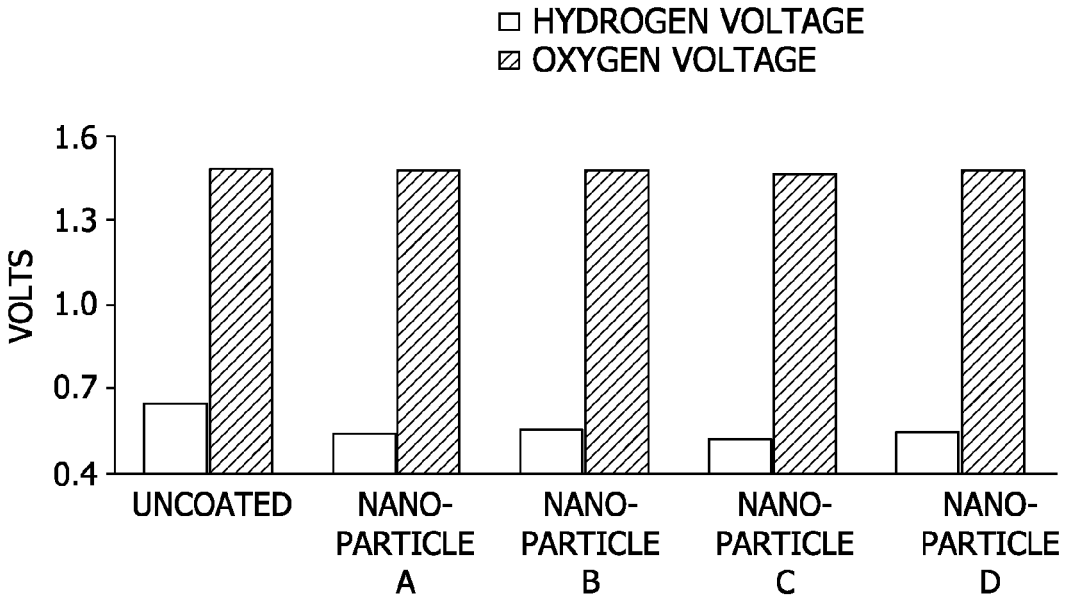
FIG. 15 shows the voltage required (relative to a saturated calomel reference) to produce both hydrogen and oxygen using electrodes including conducting material coated with an aluminum oxide coating (Nanoparticle A), a silicon dioxide coating (Nanoparticle B), a titanium oxide coating (Nanoparticle C), or a zirconium oxide coating (Nanoparticle D) contacted with an aqueous solution having a pH 2.25.
Figure 16:
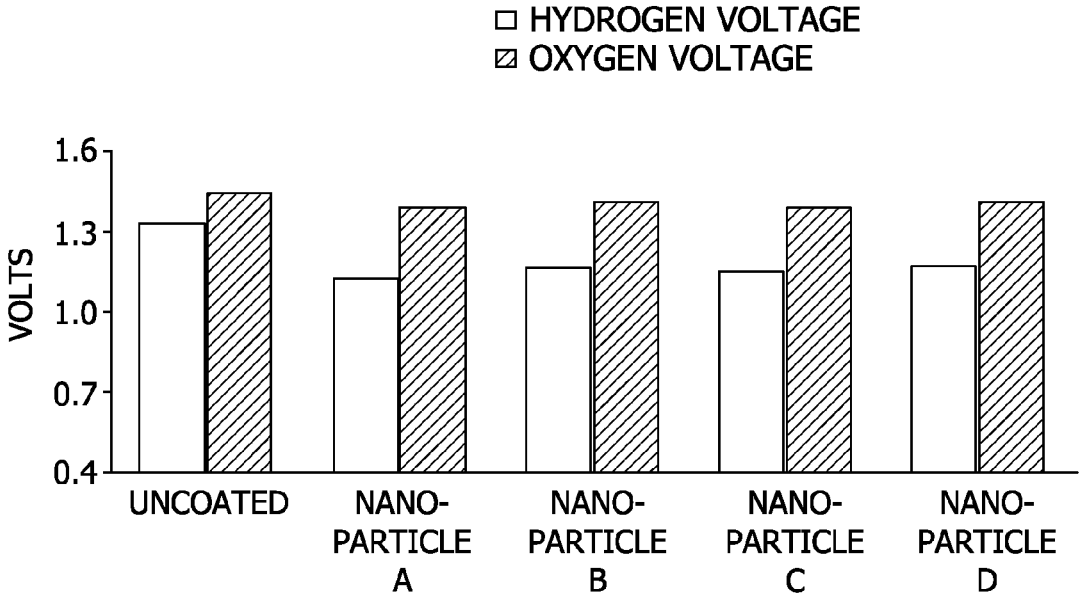
FIG. 16 shows the voltage required (relative to a saturated calomel reference) to produce both hydrogen and oxygen using electrodes including conducting material coated with an aluminum oxide coating (Nanoparticle A), a silicon dioxide coating (Nanoparticle B), a titanium oxide coating (Nanoparticle C), or a zirconium oxide coating (Nanoparticle D) contacted with an aqueous solution having a pH 6.8.
Figure 17:
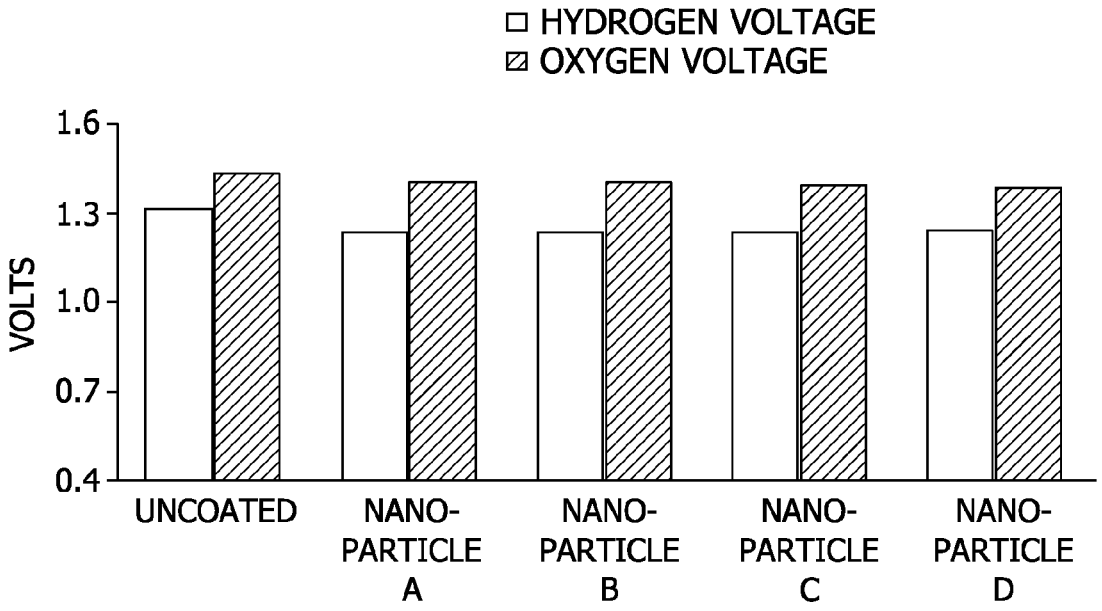
FIG. 17 shows the voltage required (relative to a saturated calomel reference) to produce both hydrogen and oxygen using electrodes including conducting material coated with an aluminum oxide coating (Nanoparticle A), a silicon dioxide coating (Nanoparticle B), a titanium oxide coating (Nanoparticle C), or a zirconium oxide coating (Nanoparticle D) contacted with an aqueous solution having a pH 11.75.

FIGS. 15-17 show the voltage required (relative to a saturated calomel reference) to produce both hydrogen and oxygen for each of the different coatings at each pH. Nanoporous oxide coatings reduced the overpotential of both the hydrogen and oxygen reactions over the entire pH range. These results also demonstrated that the hydrogen overpotential decreased dramatically at the lowest pH (pH 2.25). The oxygen overpotential increased only slightly at the lowest pH resulting in the total voltage (the sum of the hydrogen and oxygen voltage) being lowest under acidic conditions.

Figure 18:
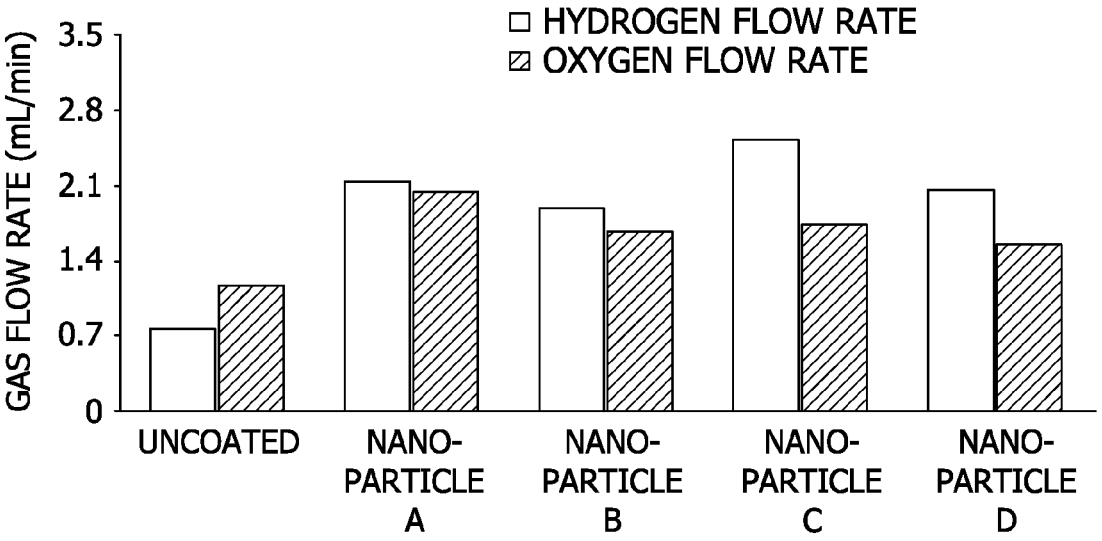
FIG. 18 shows the gas flow rates of hydrogen and oxygen produced using electrodes including conducting material coated with an aluminum oxide coating (Nanoparticle A), a silicon dioxide coating (Nanoparticle B), a titanium oxide coating (Nanoparticle C), or a zirconium oxide coating (Nanoparticle D) contacted with an aqueous solution having a pH 2.25.
Figure 19:
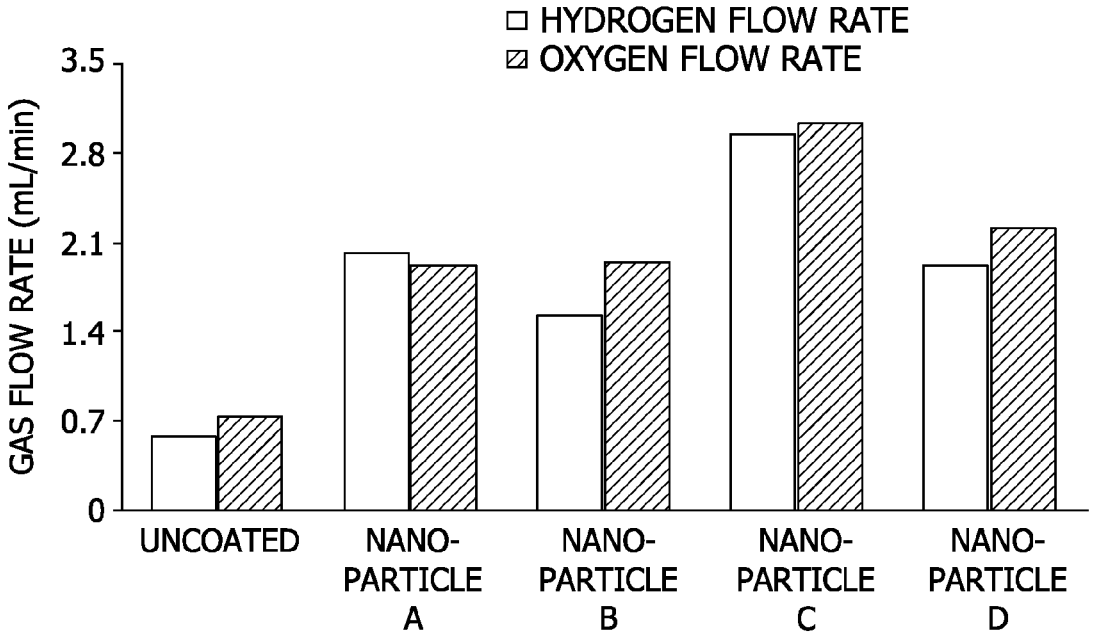
FIG. 19 shows the gas flow rates of hydrogen and oxygen produced using electrodes including conducting material coated with an aluminum oxide coating (Nanoparticle A), a silicon dioxide coating (Nanoparticle B), a titanium oxide coating (Nanoparticle C), or a zirconium oxide coating (Nanoparticle D) contacted with an aqueous solution having a pH 6.8.
Figure 20:
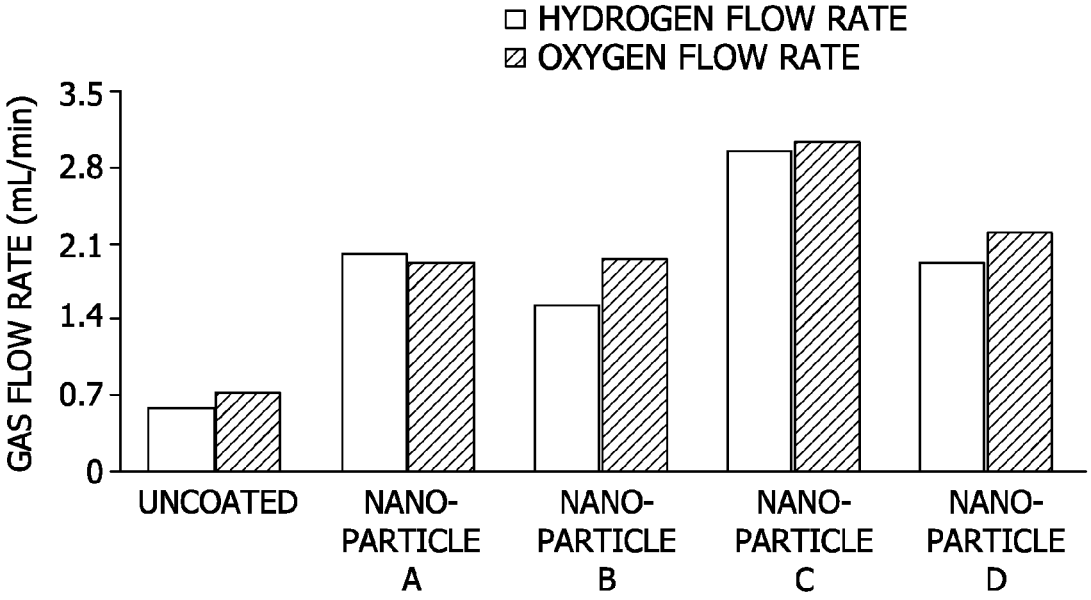
FIG. 20 shows the gas flow rates of hydrogen and oxygen produced using electrodes including conducting material coated with an aluminum oxide coating (Nanoparticle A), a silicon dioxide coating (Nanoparticle B), a titanium oxide coating (Nanoparticle C), or a zirconium oxide coating (Nanoparticle D) contacted with an aqueous solution having a pH 11.75.

Current measurements were used to estimate the hydrogen and oxygen flow rates at the different pH values. As shown in FIGS. 18-20, over three times the flow rate of hydrogen and oxygen was obtained with the nanoporous oxide coated electrodes. This increase was observed over the entire pH range. Significantly more discoloration of the basic solution was observed due to corrosion than was observed in the acidic solution.

EXAMPLE 6

In this Example, an uncoated stainless steel electrode in basic conditions was evaluated and compared to 1 layer of titanium oxide coating (Nanoparticle C) fired at a sintering temperature of 450° C. in acidic conditions for both reaction potential and gas generation.

Figure 21A:
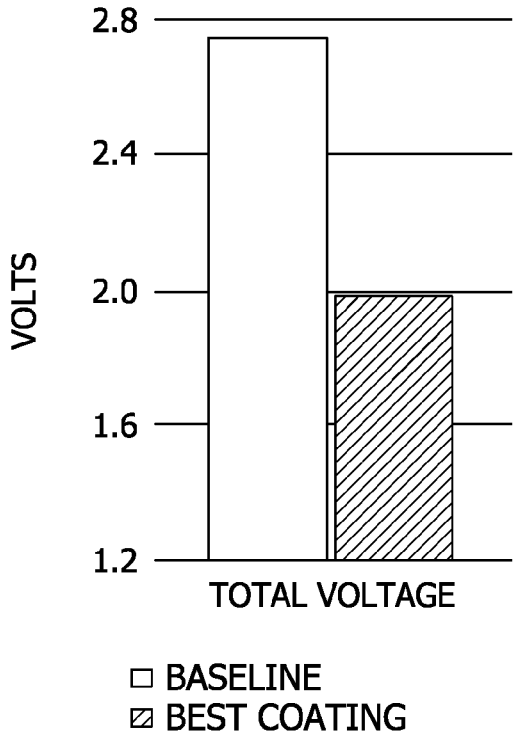
FIG. 21A shows a comparison of the total operating voltage between an electrode including an uncoated stainless steel conducting material in basic conditions versus an electrode including conducting material coated with one layer of a titanium oxide coating (Nanoparticle C) fired at a sintering temperature of 450° C. and contacted with an acidic aqueous solution.
Figure 21B:
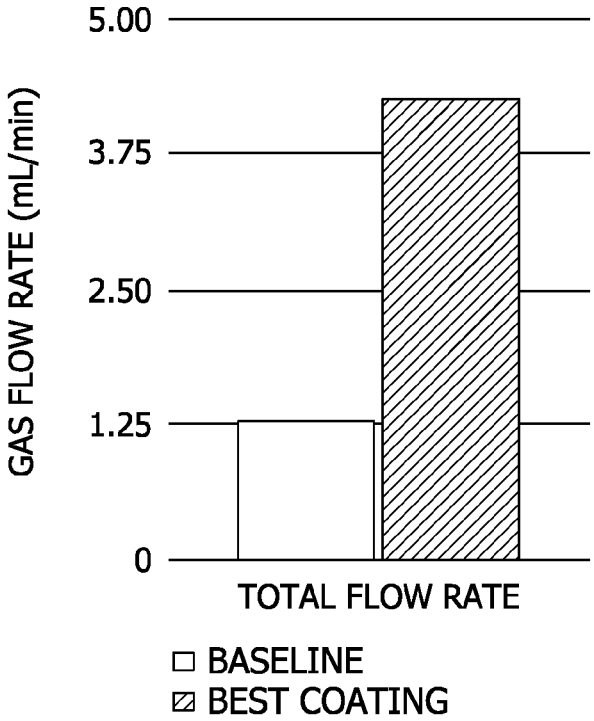
FIG. 21B shows a comparison of the total gas flow rate between an electrode including an uncoated stainless steel conducting material in basic conditions versus an electrode including conducting material coated with one layer of a titanium oxide coating (Nanoparticle C) fired at a sintering temperature of 450° C. and contacted with an acidic aqueous solution.

As shown in FIG. 21A, 1 layer of titanium oxide coating (Nanoparticle C) fired at a sintering temperature of 450° C. in acidic conditions resulted in a decrease in the operating voltage by 40%. FIG. 21B shows that 1 layer of titanium oxide coating fired at a sintering temperature of 450° C. in acidic conditions increased gas production by 330%. These results demonstrated that coating the electrode decreased the operating voltage while the gas flow rate was increased. This resulted in better performing electrolyzers and higher gas production.

Figure 22:
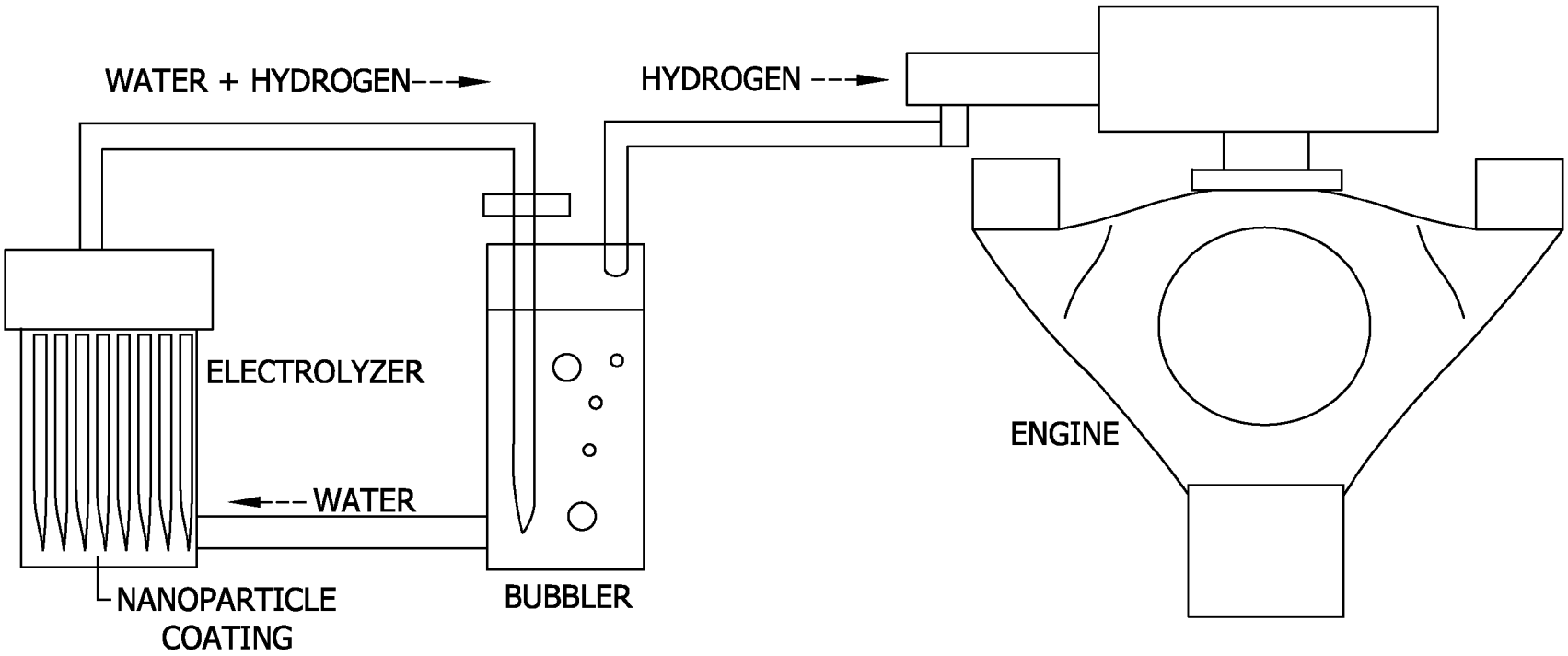
FIG. 22 depicts an electrolyzer of the present disclosure to produce hydrogen for hydrogen on demand engine systems.

As shown in FIG. 22, an electrolyzer of the present disclosure may be used to produce hydrogen for hydrogen on demand systems. Hydrogen on demand systems use a battery from a vehicle such as, for example, a scooter, to provide the electrical power for water electrolysis in the electrolyzer. The hydrogen and oxygen mixture is then fed into the engine and combined with standard fuel. Combining the hydrogen and oxygen with the standard fuel makes it possible to increase fuel mileage and improve emissions of the vehicle. As shown in Table 2, the addition of an electrolyzer of the present disclosure to a Vespa scooter dramatically reduced the carbon monoxide and hydrogen carbon emissions.

TABLE 2

Emission data for Vespa scooter with and without an electrolyzer.

| | Trial 1 | | | | Trial 2 | | | |
|---|---|---|---|---|---|---|---|---|
| | CO (%) | HC (ppm) | $CO_2$ (%) | $O_2$ (%) | CO (%) | HC (ppm) | $CO_2$ (%) | $O_2$ (%) |
| With Electrolyzer | 0.11 | 182 | 0.2 | 20.60 | 0.09 | 333 | 1.2 | 19.53 |
| Without Electrolyzer | 0.20 | 964 | 7.5 | 11.55 | 0.21 | 1057 | 7.5 | 11.44 |

Additionally, as shown in Table 3, the addition of an electrolyzer of the present disclosure to three types of commercial vehicles dramatically improved fuel economy.

TABLE 3

Percent improvement in fuel economy of commercial vehicles equipped with an electrolyzer.

| Vehicle | % Miles Per Gallon |
|---|---|
| Garbage Truck | 11% |
| GMC Canyon | 42% |
| 1 Ton Pick-up Truck | 29% |

What is claimed is:

1. An electrolyzer comprising a housing, an electrode, and an electrical power source connected to the electrode, the electrode comprising a conducting material, the electrode coated with a nanoporous oxide coating comprising a plurality of nanoporous oxide nanoparticles, wherein an atom of the nanoporous oxide coating is selected from the group consisting of beryllium, magnesium, calcium, strontium, barium, radium, titanium, zirconium, hafnium, zinc, cadmium, mercury, boron, aluminum, gallium, indium, thallium, silicon, germanium, tin, lead, and combinations thereof, and wherein the conducting material is selected from the group consisting of a porous carbon, a nonporous carbon, a porous polymer, a nonporous polymer, and combinations thereof.

2. The electrolyzer of claim 1 comprising two or more electrodes.

3. The electrolyzer of claim 1, wherein the conducting material is a porous polymer or a nonporous polymer selected from the group consisting of polyaniline, polypyrrole, polythiophenes, polyethylenedioxythiophene, poly(p-phenylene vinylene)s, and combinations thereof.

4. The electrolyzer of claim 1, wherein the electrode is coated with one to five nanoporous oxide nanoparticle layers.

5. The electrolyzer of claim 4, wherein the electrode is partially coated with the nanoporous oxide nanoparticle layers.

6. The electrolyzer of claim 1, wherein the nanoporous oxide nanoparticles comprise an oxide selected from the group consisting of silicon dioxide, zirconium oxide, titanium oxide, aluminum oxide, magnesium oxide, magnesium aluminum oxide, tin oxide, lead oxide, iron oxide, and combinations thereof.

7. The electrolyzer of claim 1, wherein the nanoporous oxide nanoparticles are made from a stable sol-gel suspension.

8. The electrolyzer of claim 1, wherein the nanoporous oxide coating has an average pore diameter from about 0.01 nm to about 500 nm.

9. The electrolyzer of claim 1, wherein the nanoporous oxide coating has an average thickness from about 0.01μm to about 50μm.

10. The electrolyzer of claim 1, wherein the nanoporous oxide coating is applied to the electrode by chemical vapor deposition, dip-coating, electrodeposition, imbibing, plasma spray-coating, spin coating, sputter-coating, slip casting, spray-coating, and combinations thereof.

11. The electrolyzer of claim 1 further comprising an aqueous solution.

12. The electrolyzer of claim 11, wherein the aqueous solution is an electrolyte-containing solution comprising an electrolyte selected from the group consisting of phosphoric acid, potassium chloride, sodium perchlorate, sodium chloride, lithium chloride, lithium nitrate, potassium nitrate, sodium nitrate, sodium hydroxide, potassium hydroxide, lithium hydroxide, ammonium hydroxide, ammonium chloride, ammonium nitrate, lithium perchlorate, calcium chloride, magnesium chloride, hydrochloric acid, nitric acid, sulfuric acid, potassium perchlorate, sodium phosphate, disodium hydrogen phosphate, monosodium phosphate, and combinations thereof.

13. A method of producing a gas by electrolysis, the method comprising:

contacting an aqueous solution with an electrode connected to an electrical power source, the electrode comprising a conducting material, the electrode coated with a nanoporous oxide coating comprising a plurality of nanoporous oxide nanoparticles, wherein an atom of the nanoporous oxide nanoparticle is selected from the group consisting of beryllium, magnesium, calcium, strontium, barium, radium, titanium, zirconium, hafnium, zinc, cadmium, mercury, boron, aluminum, gallium, indium, thallium, silicon, germanium, tin, lead, and combinations thereof, and wherein the conducting material is selected from the group consisting of a porous carbon, a nonporous carbon, a porous polymer, a nonporous polymer, and combinations thereof; and applying a voltage from the electrical power source to the electrode.

14. The method of claim 13, wherein the gas is selected from the group consisting of hydrogen, oxygen, chlorine, bromine, fluorine, and combinations thereof.

15. The method of claim 13, wherein the aqueous solution is an electrolyte-containing solution comprising an electrolyte selected from the group consisting of phosphoric acid, potassium chloride, sodium perchlorate, sodium chloride, lithium chloride, lithium nitrate, potassium nitrate, sodium nitrate, sodium hydroxide, potassium hydroxide, lithium hydroxide, ammonium hydroxide, ammonium chloride, ammonium nitrate, lithium perchlorate, calcium chloride, magnesium chloride, hydrochloric acid, nitric acid, sulfuric acid, potassium perchlorate, sodium phosphate, disodium hydrogen phosphate, monosodium phosphate, and combinations thereof.

16. A method of producing hydrogen and oxygen by electrolysis, the method comprising:

contacting an aqueous solution with an electrode connected to an electrical power source, the electrode comprising a conducting material, the electrode coated with a nanoporous oxide coating comprising a plurality of nanoporous oxide nanoparticles, wherein an atom of the nanoporous oxide nanoparticle is selected from the group consisting of beryllium, magnesium, calcium, strontium, barium, radium, titanium, zirconium, hafnium, zinc, cadmium, mercury, boron, aluminum, gallium, indium, thallium, silicon, germanium, tin, lead, and combinations thereof, and wherein the conducting material is selected from the group consisting of a porous carbon, a nonporous carbon, a porous polymer, a nonporous polymer, and combinations thereof; and applying a voltage from the electrical power source to the electrode.

17. The method of claim 16, wherein the aqueous solution is an electrolyte-containing solution comprising an electrolyte selected from the group consisting of phosphoric acid, potassium chloride, sodium perchlorate, sodium chloride, lithium chloride, lithium nitrate, potassium nitrate, sodium nitrate, sodium hydroxide, potassium hydroxide, lithium hydroxide, ammonium hydroxide, ammonium chloride, ammonium nitrate, lithium perchlorate, calcium chloride, magnesium chloride, hydrochloric acid, nitric acid, sulfuric acid, potassium perchlorate, sodium phosphate, disodium hydrogen phosphate, monosodium phosphate, and combinations thereof.

18. The method of claim 16, wherein the pH of the aqueous solution is from about 2 to about 12.

* * * * *